United States Patent [19]

Mombrei et al.

[11] Patent Number: 4,894,099

[45] Date of Patent: Jan. 16, 1990

[54] METHOD FOR INFLUENCING THE INTERNAL STRESS STATE OF SOLID RAILROAD WHEELS

[75] Inventors: Werner Mombrei; Peter Ottlinger; Klaus Wüchter, all of Dresden; Walter Rode, Halle; Günter Schulz, Delitzsch, all of German Democratic Rep.

[73] Assignee: Ministerium fuer Verkehrswesen, Berlin, German Democratic Rep.

[21] Appl. No.: 227,956

[22] Filed: Aug. 3, 1988

[30] Foreign Application Priority Data

Sep. 29, 1987 [DD] German Democratic Rep. ... 307372

[51] Int. Cl.[4] ..... C21D 9/32

[52] U.S. Cl. ..... 148/146; 148/134

[58] Field of Search ..... 148/146, 134

[56] References Cited

U.S. PATENT DOCUMENTS 1,391,907 9/1921 Schaffer ..... 148/146
3,558,367 1/1971 Eck ..... 148/146

FOREIGN PATENT DOCUMENTS 837982 6/1981 U.S.S.R. ..... 148/146
1247569 9/1971 United Kingdom ..... 148/146

*Primary Examiner*—Deborah Yee
*Attorney, Agent, or Firm*—Jordan and Hamburg

[57] ABSTRACT

The invention relates to the regeneration of solid rail road wheels, the operating safety of which is impaired by the danger of rupture or buckling, by the action of the block brake, especially after the brake has been acting for a long time by influencing the active internal stress state in the wheel rim, in such a fashion that damaging effects are no longer present in the sense of reduced operating safety. This is achieved by heating the wheel center of the solid railroad wheel. The heating process is such that plastic deformation occurs, especially in the area of maximum internal stress and the internal stresses in the solid wheel can thereby be relieved. The temperature difference required for this, between the heated area of the wheel center and the wheel rim is at least 100 deg C.

5 Claims, 1 Drawing Sheet

METHOD FOR INFLUENCING THE INTERNAL STRESS STATE OF SOLID RAILROAD WHEELS

BACKGROUND OF THE INVENTION

The invention relates to a method for regenerating solid railroad wheels, the operating reliability of which has been impaired by danger of rupture or buckling due to the action of the block brake, especially after the brake has been acting for a longer time.

It is well known that solid wheels, which have been distorted by the block brake, can be restored to their rated gauge by repressing. This requires not only complicated equipment, but also complicated assembly and disassembly. However, reprocessing does not affect the internal stress state of the wheel. Furthermore, a method is known for regenerating solid railroad wheels, which have been thermally overstressed by the block brake, in which the internal tensile stresses resulting from the overstress are relieved by heating and cooling the wheel rim (DD-WP 212 256). This method has the disadvantage, however, that it affects only the active internal stress component directly at the wheel rim, and thus solves the existing problem only partially and with relatively great effort.

SUMMARY OF THE INVENTION

It is an object of the invention to provide a method which makes possible the economical restoration of solid wheels which can no longer be regarded as safe for operation due to their thermal overstress.

The object of the invention is to relieve the active internal stress state in the wheel rim, which has been caused by thermal stresses, by changing the radial support effects and thus the radial internal stress components in the wheel center. Pursuant to the invention, this object is achieved in the following ways: The wheel center of a solid railroad wheel, individually or in a wheel set, is heated homogeneously over its circumference until a plastic deformation occurs, especially in the area $\sigma^{E}$max (i.e., area of maximum internal stress), the temperature difference between the heated region of the wheel center and the rim flange being at least 100 deg C. The temperature is gradually reduced in the direction of the wheel rim fillet or wheel hub. The required temperature difference can also be achieved in conjunction with a cooling at the wheel rim. An inverse relationship exists between the magnitude of the internal stresses that are to be relieved and the necessary temperature difference, that is, the larger the internal stresses in the solid railroad wheel, the lower is the temperature difference required to relieve these stresses. A homogeneous heat distribution should be achieved over the circumference, for example, by rotating the solid railroad wheel during the heating process or by using an annular heat source. The inventive method can also be used for simultaneously heating both wheels of a wheel set. This offers the possibility of appropriately treating solid wheels even in their installed state, thus obviating the need for disassembling the wheel sets.

BRIEF FIGURE DESCRIPTION

The inventive solution is explained in more detail in the following by way of an example of the operation.

FIG. 1 schematically shows a system for implementing the process.

DESCRIPTION OF THE PREFERRED EMBODIMENT

Figure 1:
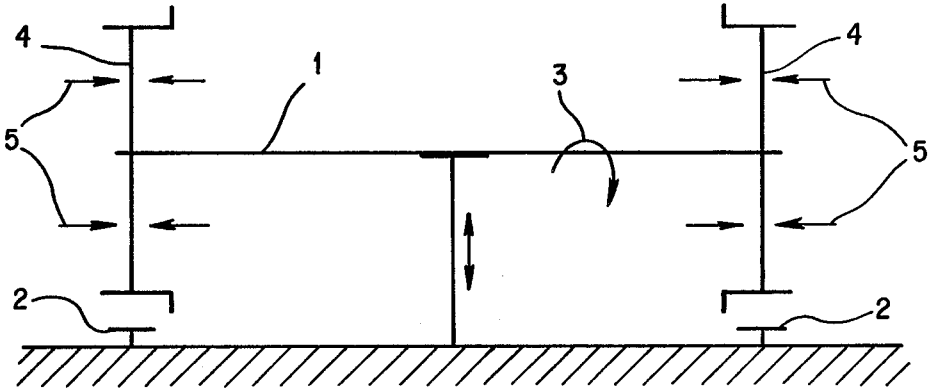

A complete wheel set 1, with solid railroad wheels that are to be regenerated, is brought to a wheel set receiver along the guide rail 2, and is raised into the position, for regeneration, as illustrated.

The wheel set 1 is then caused to rotate by a wheelset drive 3, and the wheel centers 4 are heated homogeneously with the burner 5 to at least 200 deg C. and at most 600 deg C. The temperature in the area of the wheel rim fillets and the hub may not exceed 300 deg C. The wheel set is then cooled slowly.

We claim:

1. A method for relieving the active internal stress state in the wheel rim of solid railroad wheels caused by thermal stresses, comprising homogeneously heating a wheel center of a solid railroad wheel having a wheel rim, a hub and therebetween a wheel center, individually or in a wheel set, over its circumference until a plastic deformation occurs in an area including an area of maximum internal stress, the temperature of the wheel rim being less than the temperature of the heated wheel center and not exceeding 300 deg. C. and the temperature difference between the heated region of the wheel center and the wheel rim being at least 100 deg. C.

2. The method of claim 1, comprising combining the heating of the wheel center with a cooling of the wheel rim.

3. The method of claim 1, wherein the temperature of the hub is less than the temperature of the heated wheel center and does not exceed 300 deg. C.

4. The method of claim 1, wherein the wheel center is heated to a temperature in the range of 200 deg. C. to 600 deg. C.

5. The method of claim 3, wherein the wheel center is heated to a temperature in the range 200 deg. C. to 600 deg. C.

* * * * *